US005992333A

United States Patent [19]

Lai

[11] Patent Number: 5,992,333

[45] Date of Patent: Nov. 30, 1999

[54] TABLE HAVING AN EASILY FOLDING MECHANISM

[76] Inventor: Chih-Shuang Lai, No. 27, Nung 35, Lane 851, Chung Shan Road, Shen Kang Hsiang Taichung Hsien, Taiwan

[21] Appl. No.: 09/093,041

[22] Filed: Jun. 8, 1998

[51] Int. Cl.[6] ..... A47B 3/02

[52] U.S. Cl. ..... 108/117; 108/157.1; 108/115

[58] Field of Search ..... 248/434, 439, 248/188.6, 184.7; 108/157.1, 157.18, 157.12, 153.1, 117, 115, 128

[56] References Cited

U.S. PATENT DOCUMENTS

| | | | |
|---|---|---|---|
| 493,925 | 3/1893 | Griffin | 108/128 |
| 603,474 | 5/1898 | Sebold | 108/157.12 X |
| 3,709,167 | 1/1973 | Sprigman | 108/128 |
| 5,037,086 | 8/1991 | Strand | 108/117 X |
| 5,205,223 | 4/1993 | Ball et al. | 108/115 X |
| 5,325,794 | 7/1994 | Hontani | 108/117 |

FOREIGN PATENT DOCUMENTS

| | | | |
|---|---|---|---|
| 566631 | 11/1923 | France | 108/128 |
| 361633 | 10/1922 | Germany | 108/128 |

*Primary Examiner*—Jose V. Chen
*Attorney, Agent, or Firm*—Charles E. Raxley, Esq.

[57] ABSTRACT

A table includes a table plate to be supported on top of a base member. The base member includes a bolt, a pair of seats secured on the bolt, and two pairs of legs pivotally coupled to the seats at pivot pins and foldable about the pivot pins between a folded position and an opened position. Two stops are threaded on the bolt and engaged with the legs for maintaining the legs at the selected tilted angle relative to the bolt. Two locks each includes an inner thread engaged with the outer thread of the seats for locking the legs in place when the locks are secured on the seats. The legs may be easily and quickly rotated about the pivot pins to the folded position when the locks are disengaged from the seats.

6 Claims, 9 Drawing Sheets

TABLE HAVING AN EASILY FOLDING MECHANISM

BACKGROUND OF THE INVENTION

1. Field of the Invention

The present invention relates to a table, and more particularly to a table which may be easily folded to a compact configuration.

2. Description of the Prior Art

Typical tables comprise a base member that may be folded to a storing size. However, the foldable base member normally includes a huge size and includes a number of bolts that are required to be threaded or unthreaded for assembling and disassembling the base member.

The present invention has arisen to mitigate and/or obviate the afore-described disadvantages of the conventional foldable tables.

SUMMARY OF THE INVENTION

The primary objective of the present invention is to provide a table which includes an easily folding mechanism for allowing the door to be easily and quickly folded to a compact folding configuration.

In accordance with one aspect of the invention, there is provided a table comprising a table plate, a base member including a bolt, a pair of seats secured on the bolt, two pairs of legs pivotally coupled to the seats at pivot pins and foldable about the pivot pins between a folded position and an opened position, means for maintaining the legs at the opened position, means for releasably locking the legs at the opened position, and means for securing the table plate on top of the base member.

The seats each includes a pair of channels for receiving the legs when the legs are rotated about the pivot pins to the folded position.

Each of the seats includes an outer thread, the releasably locking means includes two locks each having an inner thread for engaging with the outer thread of the seats and for allowing the locks to engage with and to lock the legs in place when the locks are secured on the seats, and the legs are allowed to rotate about the pivot pins to the folded position when the locks are disengaged from the seats.

The legs maintaining means includes two stops threaded on the bolt, the stops are engaged with the legs for maintaining the legs at a selected tilted angle relative to the bolt. The stops each includes a tapered surface for engaging with the legs.

The table plate securing means includes two pairs of beams pivotally coupled to the seats at pivot pins, the beams each includes a free end, and means for securing the free ends of the beams to the table. The beam securing means includes two pairs of couplers secured to the free ends of the beams and each having a pivotal bracket for securing to the table.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
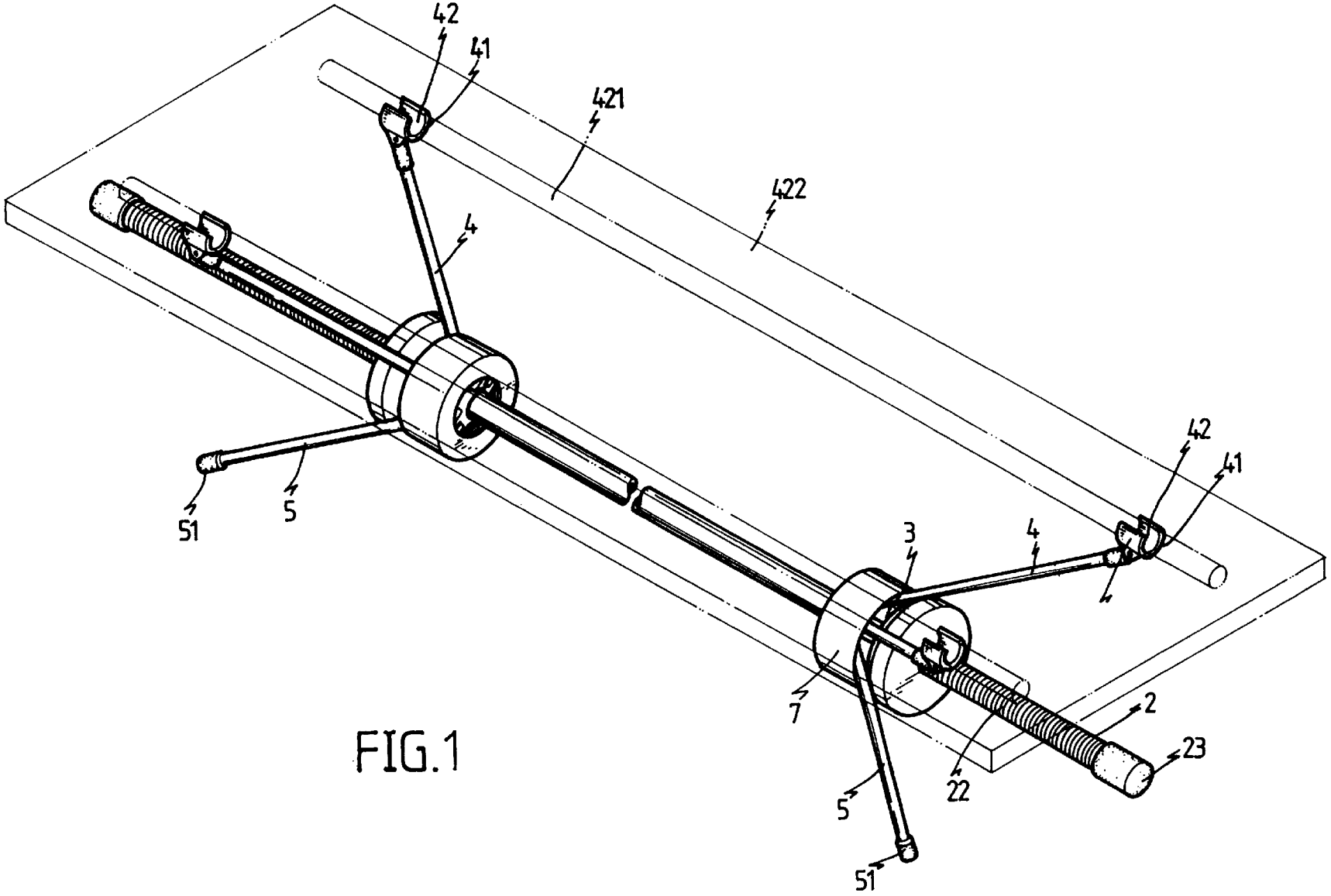
FIG. 1 is a perspective view of a table in accordance with the present invention.
Figure 2:
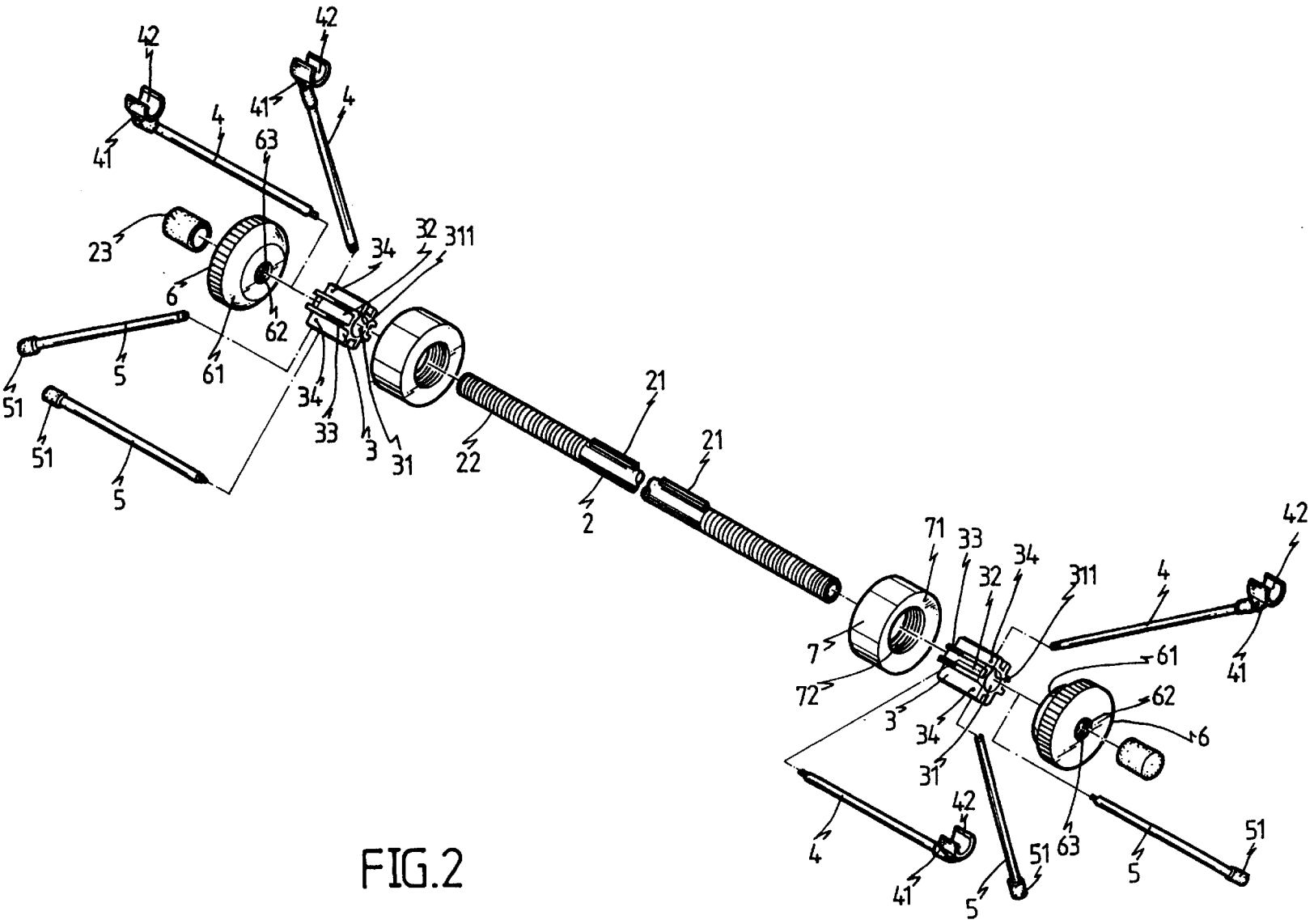
FIG. 2 is an exploded view of the base member.

Referring to the drawings, and initially to FIGS. 1–5, a table in accordance with the present invention comprises a base member for supporting a table plate 422 which includes a pair of tracks or rods 421 secured to the bottom. The base member includes a bolt 2 having two keys 21 and an outer thread 22. Two caps 23 are secured to the ends of the bolt 2. Two seats 3 each includes a bore 31 for receiving the bolt 2 and each includes a groove 311 for slidably receiving the keys 21 and for preventing the seats 3 from rotating relative to the bolt 2. The seats 3 each includes an outer thread 33 and each includes four channels 32 formed therein for receiving two pairs of beams 4 and legs 5 respectively which are pivotally coupled to the seats 3 at pivot pins 34. Two bolts 35 (FIG. 4) may further be threaded through the seats 3 and engaged with the bolt 2 for solidly securing the seats 3 to the bolt 2. The beams 4 and the legs 5 may be rotated about the pivot pins 34 to the storing position that is parallel to the bolt 2 (FIG. 6) or to the opened working position as shown in FIGS. 1 and 3–5.

Figure 3:
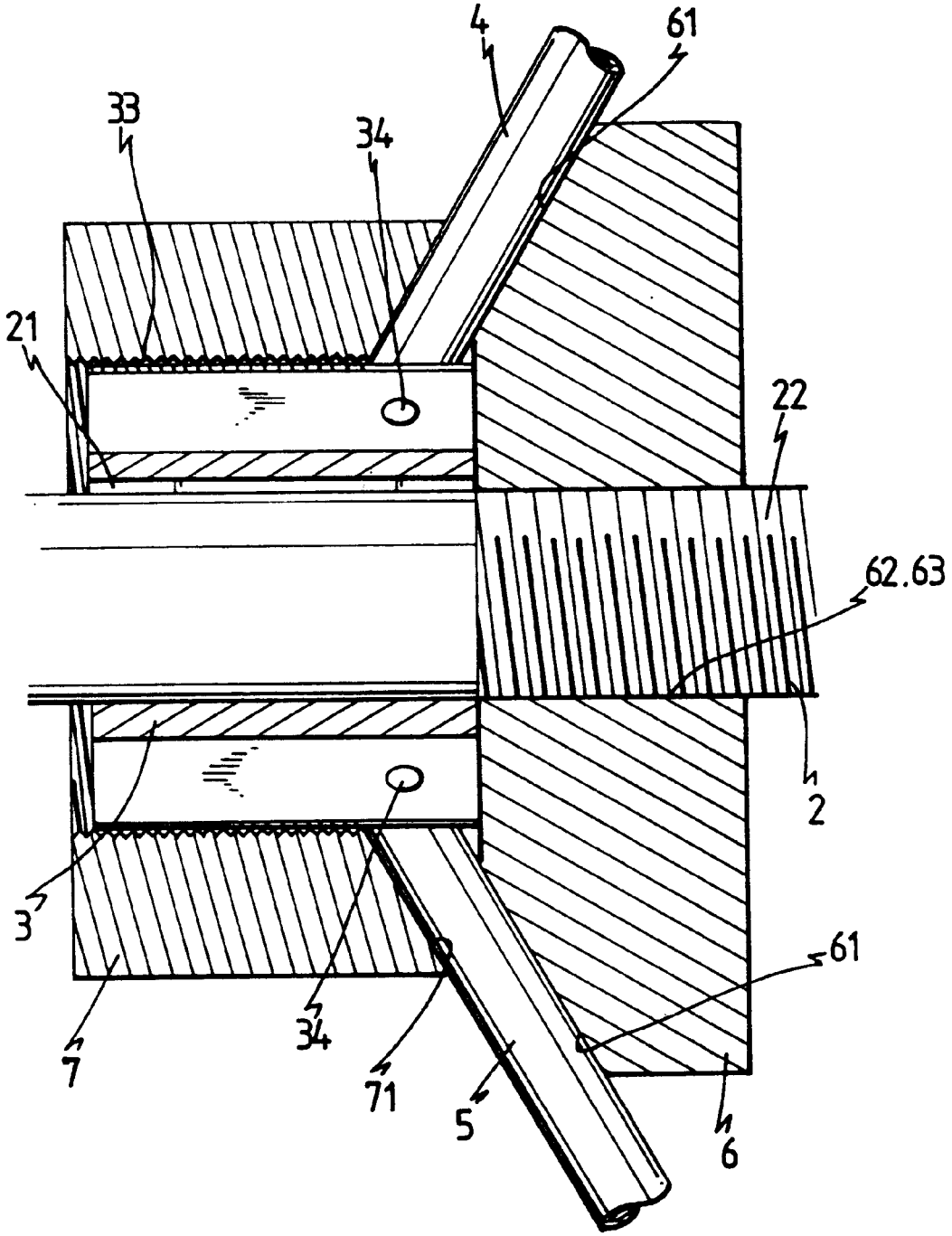
FIG. 3 is a partial cross sectional view of the base member.
Figure 4:
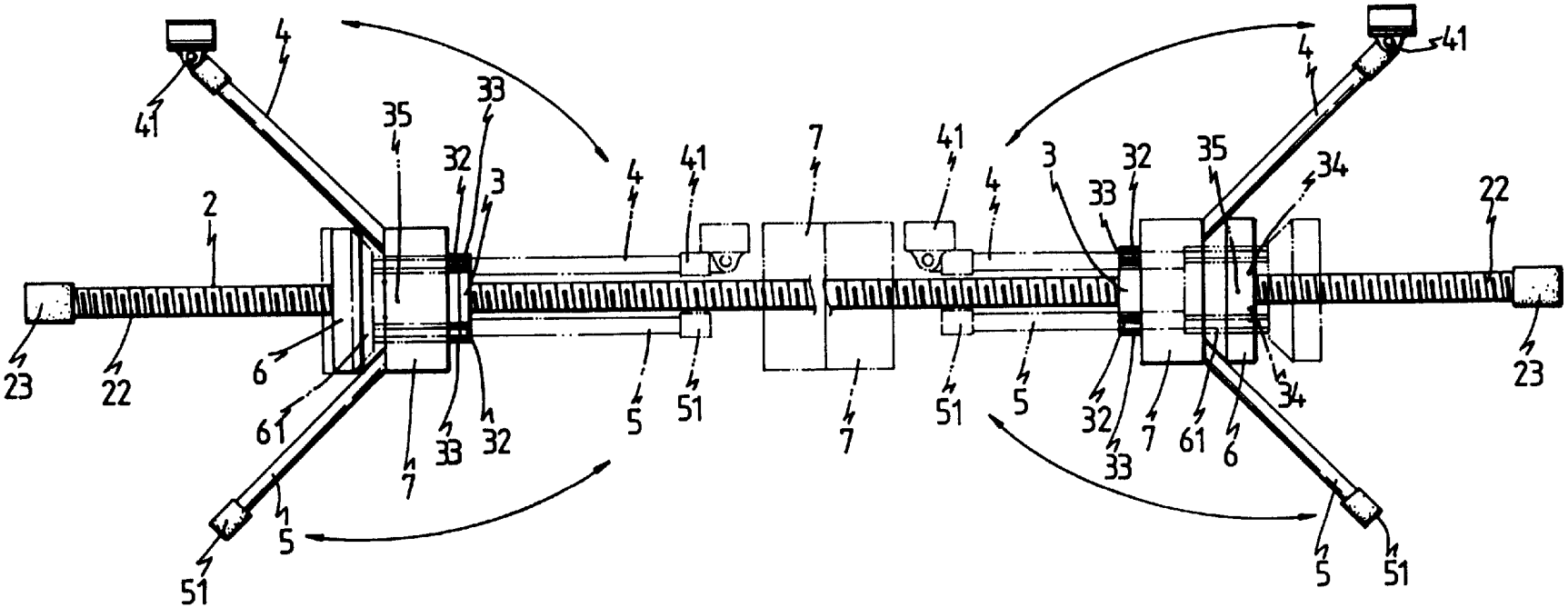
FIG. 4 is a plan view of the base member.
Figure 5:
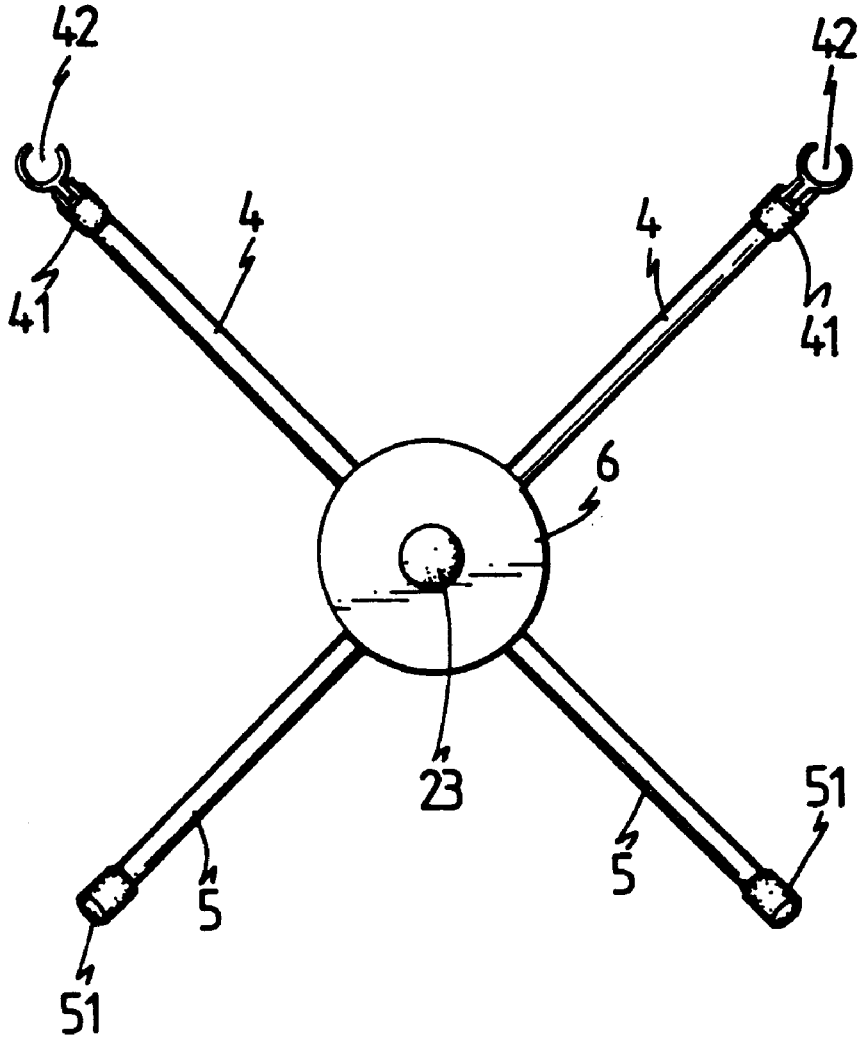
FIG. 5 is an end view of the base member.

Two stops 6 each includes a hole 62 having an inner thread 63 for engaging with the outer thread 22 of the bolt 2 and each includes an annular tapered surface 61 for engaging with the beams 4 and the legs 5 (FIGS. 1, 3, 4). The stops 6 may be adjusted and moved relative to the seats 3 (FIG. 4) for adjusting the tilted angle of the beams 4 and the legs 5 relative to the bolt 2. The beams 4 each includes a coupler 41 secured to the free end and having a U-shaped pivotal bracket 42 for engaging with the rods 421 of the table plate 422 and for securing the base member to the table plate 422, and the legs 5 each includes a pad 51 secured to the free end for engaging with the supporting ground surface. Two locks 7 each includes an inner thread 72 for threadedly engaging with the outer thread 33 of the seats 3 and for securing to the seats 3 respectively. The locks 7 each includes an annular tapered surface 71 for engaging with and for locking the beams 4 and legs 5 in place (FIG. 3).

Figure 6:
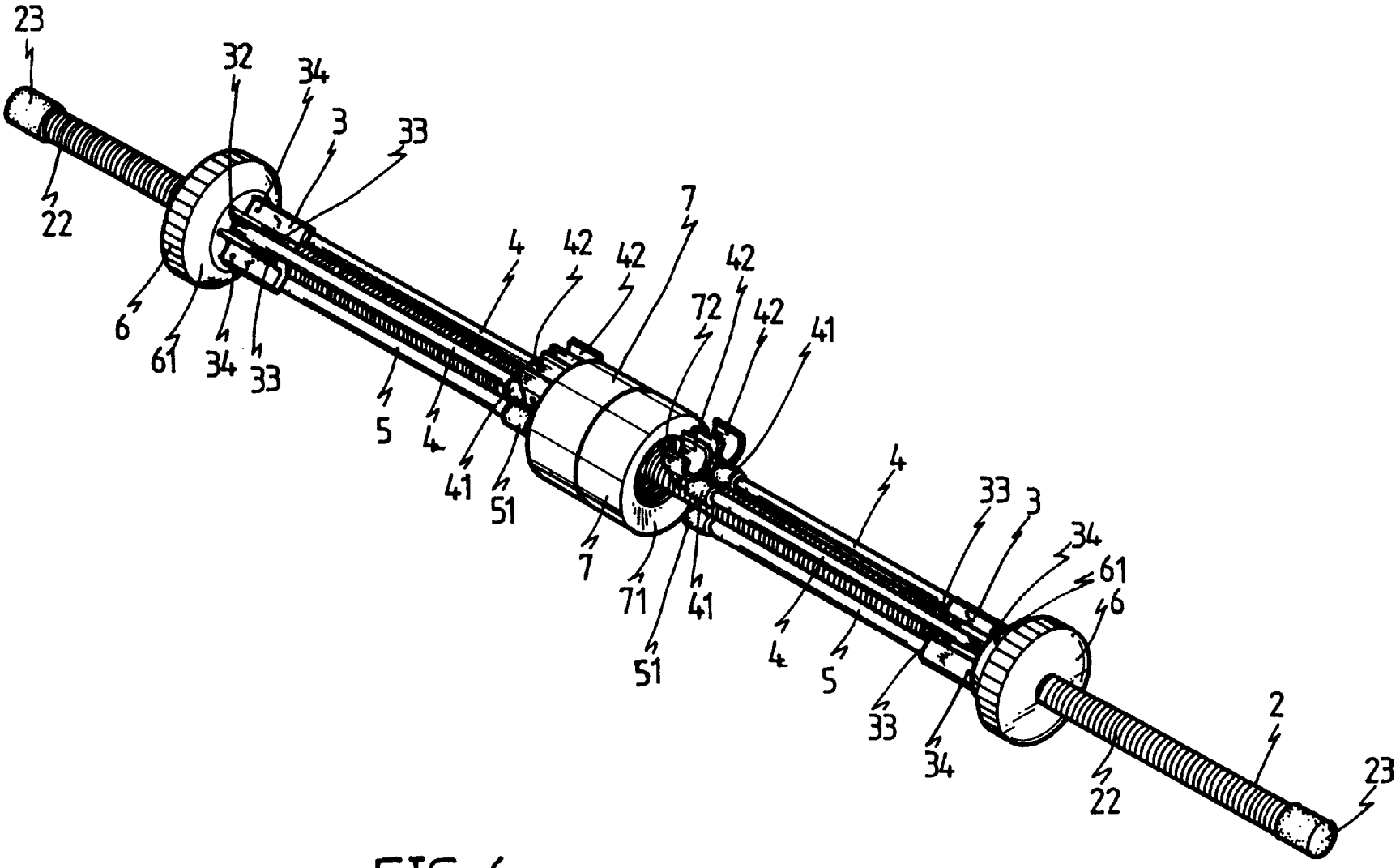
FIG. 6 is a perspective view illustrating the base member that is folded to the folding configuration.

Referring next to FIG. 6, when the locks 7 are disengaged from the seats 3, the beams 4 and the legs 5 may be folded about the pivot pins 34 to the folding position, such that the base member may be easily and quickly folded storing configuration. When it is required to open the base member for working purposes, it is only required to rotate the beams 4 and the legs 5 about the pivot pins 34 and to thread the locks 7 with the seats 3, such that the base member may be easily and quickly opened.

Figure 7:
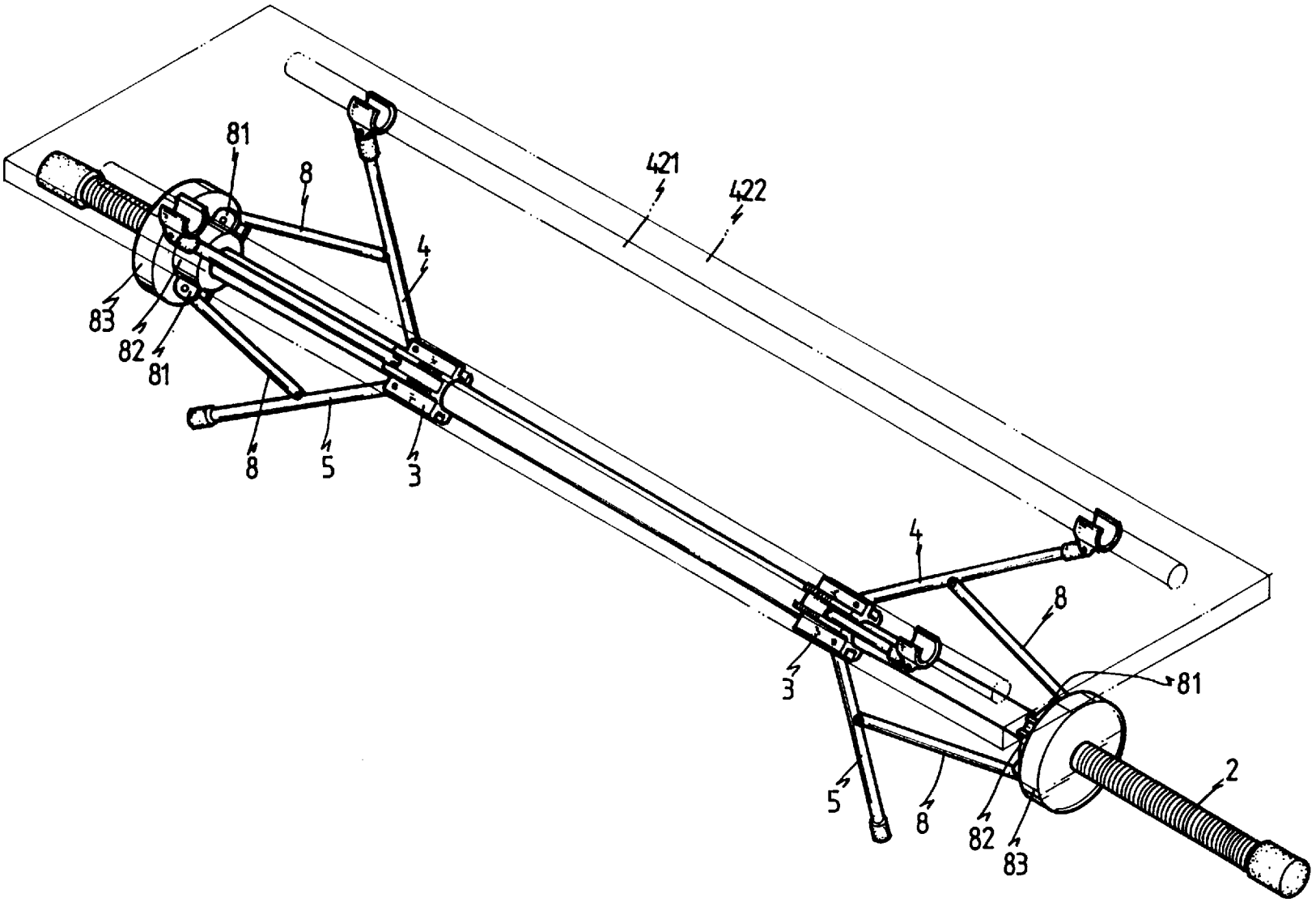
FIGS. 7 and 8 are perspective views illustrating the other application of the base member.
Figure 8:
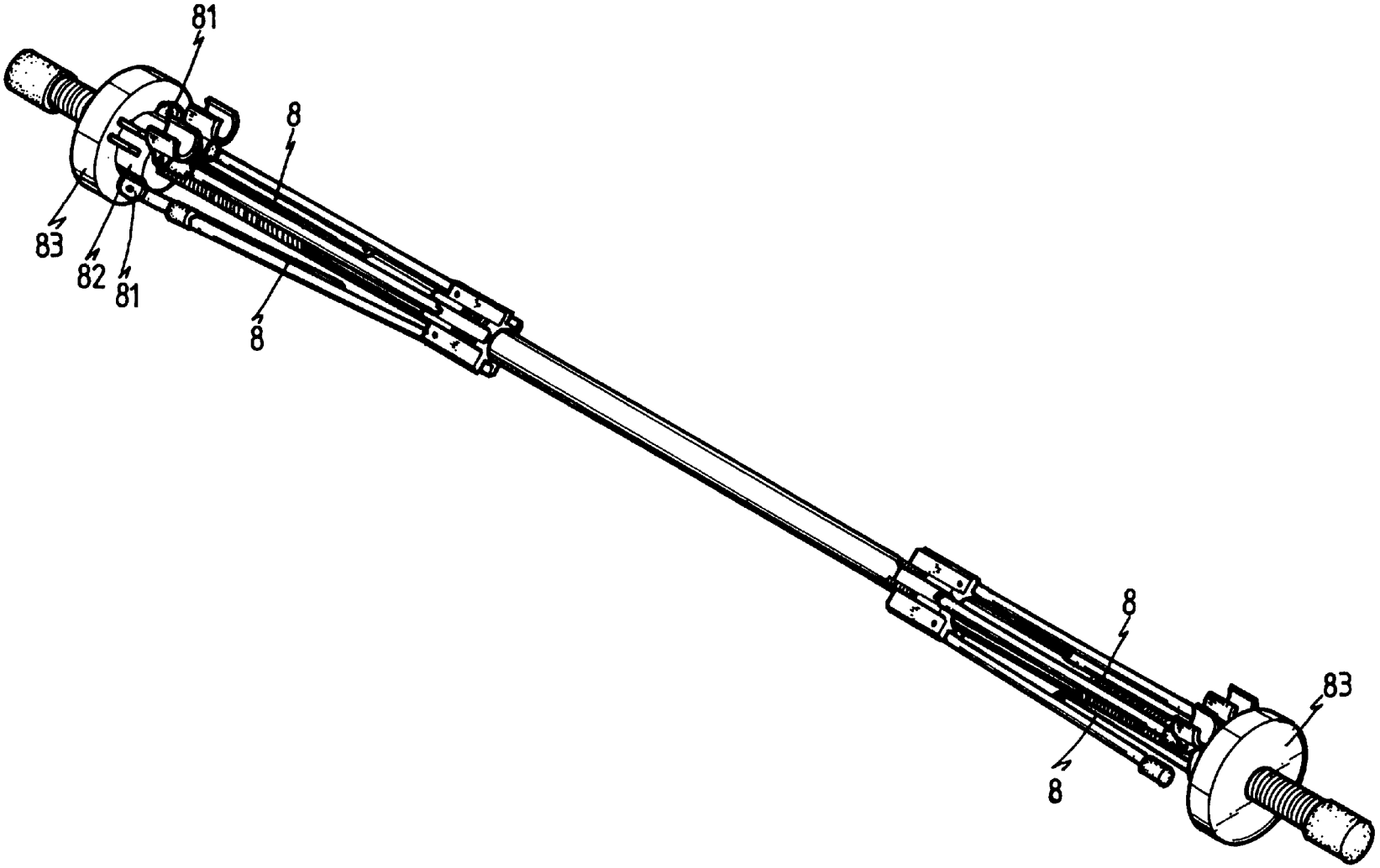

Referring again to FIGS. 7 and 8, without the locks 7, two rings 82 are slidably engaged on the bolt 2 and each includes a number of ears 81 pivotally coupled to the beams 4 and the legs 5 by links 8. The stops 83 are threaded with the bolt 2 for moving the rings 82 toward the seats 3 and for opening the beams 4 and the legs 5, or for moving the rings 82 away from the seats 3 and for allowing the beams 4 and the seats 5 to be folded to the compact folding and storing configuration (FIG. 8).

Figure 9:
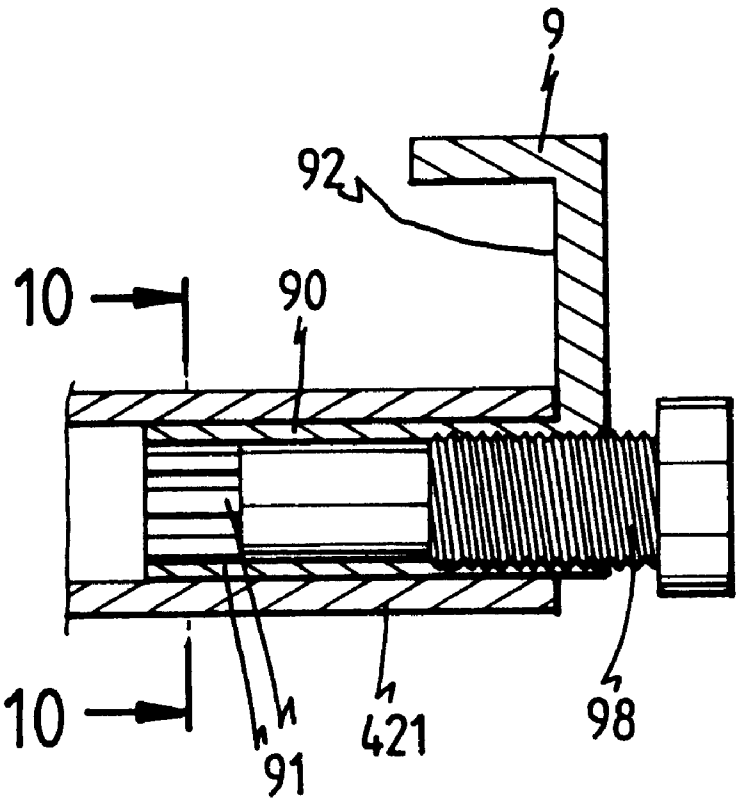
FIG. 9 is a partial cross sectional view showing a table support.
Figure 10:
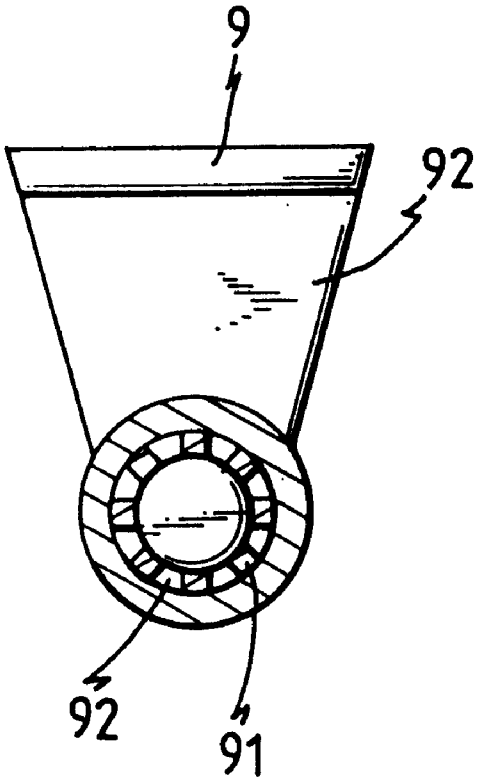
FIG. 10 is a cross sectional view taken along lines 10—10 of FIG. 9.

Referring next to FIGS. 9 and 10, two brackets 9 are further provided and each includes a recess 92 for receiving the side edges of the table plate 422 and each includes a tubular member 90 engaged in the ends of the rods 421. The tubular members 90 each includes a number of longitudinal bars 91 defined by a number of slits 92. Two further bolts 98 may be threaded with the tubular members 90 for forcing the bars 91 to engage with the rods 421 and for solidly securing the brackets 9 to the table plate 422.

Accordingly, the table in accordance with the present invention includes an easily folding mechanism for allowing the table to be easily and quickly folded to a compact folding configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A table comprising:

a) a table plate, b) a base member including:

i) a bolt, ii) a pair of seats secured on said bolt, said seats each including an outer thread, iii) two pairs of legs pivotally coupled to said seats at pivot pins and foldable about said pivot pins between a folded position and an opened position, iv) means for maintaining said legs at said opened position, v) means for releasably locking said legs at said opened position, and said releasably locking means including two locks each having an inner thread for engaging with said outer thread of said seats, said locks being engaged with said legs when said locks are threaded onto said seats for locking said legs in place, and said legs being released when said locks are disengaged from said seats for allowing said legs to rotate about said pivot pins to said folded position, c) means for securing said table plate on top of said base member.

2. The table according to claim 1, wherein said seats each includes a pair of channels for receiving said legs when said legs are rotated about said pivot pins to the folded position.

3. The table according to claim 1, wherein said legs maintaining means includes two stops threaded on said bolt, said stops are engaged with said legs for maintaining said legs at a selected tilted angle relative to said bolt.

4. The table according to claim 1, wherein said table securing means includes two pairs of beams pivotally coupled to said seats at pivot pins, said beams each includes a free end, and means for securing said free ends of said beams to said table plate.

5. The table according to claim 4, wherein said beam securing means includes two pairs of couplers secured to said free ends of said beams and each having a pivotal bracket for securing to said table plate.

6. A table comprising:

a) a table plate, b) a base member including:

i) a bolt, ii) a pair of seats secured on said bolt, iii) two pairs of legs pivotally coupled to said seats at pivot pins and foldable about said pivot pins between a folded position and an opened position, iv) means for maintaining said legs at said opened position, said legs maintaining means including two stops threaded on said bolt to engage with said legs, said stops each including a tapered surface engaged with said legs for maintaining said legs at a selected tilted angle relative to said bolt, v) means for releasably locking said legs at said opened position, and c) means for securing said table plate on top of said base member.

* * * * *